United States Patent [19]

Kampichler et al.

[11] Patent Number: 4,467,767

[45] Date of Patent: Aug. 28, 1984

[54] FUEL INJECTION PUMP FOR INTERNAL COMBUSTION ENGINES

[75] Inventors: Günter Kampichler, Mühlacker; Heinz Kuschmierz, Gerlingen; Bernhard Schenk, Stuttgart, all of Fed. Rep. of Germany

[73] Assignee: Robert Bosch GmbH, Stuttgart, Fed. Rep. of Germany

[21] Appl. No.: 359,631

[22] Filed: Mar. 18, 1982

[30] Foreign Application Priority Data

Mar. 21, 1981 [DE] Fed. Rep. of Germany ... 8108316[U]
Jan. 26, 1982 [DE] Fed. Rep. of Germany ..... 3202405

[51] Int. Cl.[3] ..... F02M 59/02

[52] U.S. Cl. ..... 123/467; 123/506; 137/493.6; 417/296

[58] Field of Search ..... 123/467, 495, 506; 137/493.4, 493.3, 493.1, 493.6, 493.8, 493.9; 417/296

[56] References Cited

U.S. PATENT DOCUMENTS

| | | | |
|---|---|---|---|
| 1,933,454 | 10/1933 | Sidney | 137/493.6 |
| 2,247,421 | 7/1941 | Tabb et al. | 123/139 |
| 2,384,011 | 9/1945 | Bremser | 103/41 |
| 2,713,310 | 7/1955 | Muraszew | 123/506 |
| 3,195,465 | 7/1965 | Hug | 103/41 |
| 3,309,024 | 3/1967 | Maddalozzo | 137/493.6 |
| 3,477,458 | 11/1969 | Maddalozzo | 137/493.3 |
| 3,479,999 | 11/1969 | Keller et al. | 123/139 |
| 3,762,386 | 10/1973 | Vuaille | 123/467 |
| 3,965,876 | 6/1976 | Tissot | 123/467 |
| 4,074,668 | 2/1978 | Indra | 123/506 |
| 4,273,091 | 6/1981 | Stumpp | 123/506 |

FOREIGN PATENT DOCUMENTS

| | | | |
|---|---|---|---|
| 1289359 | 2/1969 | Fed. Rep. of Germany | 123/467 |
| 394710 | 12/1965 | Switzerland . | |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump for internal combustion engines having an equal-pressure relief valve, which has a structure requiring little space when installed and is provided with a fastener element. The equal-pressure relief valve comprises a pressure valve body, onto which a beaker-shaped filler piece protruding into the interior of the pressure valve spring is placed. The structural unit comprising the pressure valve body and the filler piece containing the relief valve is held together, even when the pipe connector fitting or the pressure valve spring is removed, by means of the transit fastener element provided with a fastener ring. The invention is applicable both to single and series fuel injection pumps as well as to distributor injection pumps, particularly when space for installation is restricted.

11 Claims, 8 Drawing Figures

FUEL INJECTION PUMP FOR INTERNAL COMBUSTION ENGINES

BACKGROUND OF THE INVENTION

The invention is based on a fuel injection pump as generally described hereinafter. In a known fuel injection pump of this kind, equipped with an equal-pressure relief valve, a filler piece containing the relief valve is used, instead of a filler piece otherwise required for reducing the clearance volume and held by the pressure valve spring inside the tube fitting piece, and it may also serve if necessary as a stroke limitation means for the pressure valve body. This structural type requires little space, and pressure valves, whether or not equipped with a return-feed shoulder, can be modified and converted into equal-pressure relief valves while retaining the most important structural components of the generally available size. Conventional fuel injection pumps now available on the market can thus be modified or retrofitted easily. However, attempts to use such valves have heretofore failed, among other reasons because during the installation or removal of the valve or valve body, the valve spring of the relief valve tended to cause the component unit to fly apart. This meant that individual structural components might be lost, or might even fall into the pump work chamber without being observed, causing the destruction of the entire injection pump with the attendant errors as a consequence.

OBJECT AND SUMMARY OF THE INVENTION

In the fuel injection pump according to the invention, the above disadvantages are avoided, and the fastener element described by the characteristics of the main claim serves to keep the valve unit, which substantially comprises the pressure valve body and the filler piece, intact even when the pipe connector fitting has been removed.

Further advantageous embodiments and modifications of the subject of the application are disclosed in the dependent claims. In a fastener element equipped according to claims 2 and 3, the assembly comprising the pressure valve body and the filler piece is kept intact even when the pressure valve spring is removed, and by means of the characteristics of claim 4 the snap connection according to the invention can be realized in a simple manner. In the instance of an unfavorable tolerance situation, the characteristics of claim 5 assure that the sealing faces between the filler piece and the pressure valve body will not fail to contact one another sufficiently well to effect sealing; the snap connection furthermore enables the simple disassembly of the pressure valve assembly.

A further variant embodiment of the fastener element according to the invention is defined by the characteristics of claim 6, and the crimped ring of this fastener element, which [crimped ring] is firmly held by the pressure valve spring, is embodied as a simple deep-drawn sheet-metal part and can be fabricated inexpensively with only a single annular groove on the pressure valve body. The same advantages also apply to a fastener element embodied in accordance with claim 7.

The fastener element of the fuel injection pump according to the invention and embodied as disclosed in claim 8 is usable in a particularly advantageous fashion in the instance where the pressure valve body is dimensioned for the supply of very small supply quantities and no more room is available on such a body for a fastener element. In removing the pipe connector fitting, the outer snap ring keeps the unit comprising the pressure valve body and the filler piece intact within the pipe connector fitting, so that the components of the relief valve cannot be lost.

If the fuel injection pump according to the invention is provided with a fastener element embodied as defined by claims 10 and 11, then when the pipe connector fitting is removed the entire equal-pressure relief valve, including the valve housing as well, is kept intact within the pipe connector fitting. This can be used to particular advantage when installation space is very restricted, as in the case of distributor injection pumps.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
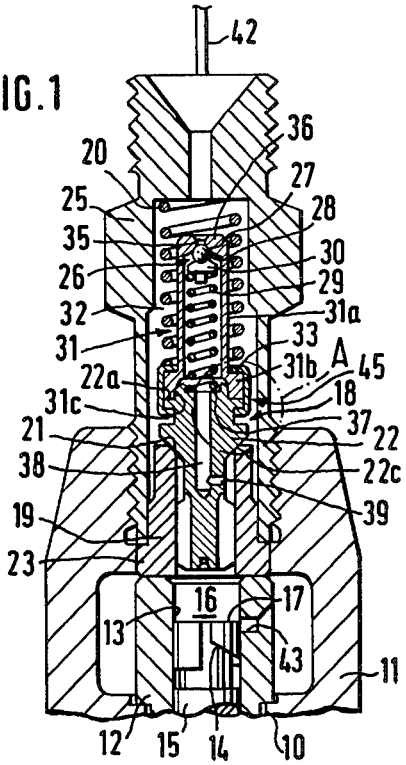
FIG. 1 is a longitudinal cross-sectional view taken through the first exemplary embodiment of a fuel injection pump according to the invention.

Turning now to the partial view of FIG. 1, pump cylinder 12 is placed in a bore 10 of a pump housing 11 of the first exemplary embodiment of an injection pump. A pump piston 15 provided with an oblique control edge 14 slides within the cylinder bore 13 of the pump cylinder 12. The elements of the cam drive mechanism and rotation device for varying the fuel quantity, which are known per se, are accordingly not shown. The cylinder bore 13 includes a pump work chamber 16, which is defined on one side by one end 17 of the pump piston 15 and on the other by an equal-pressure relief valve 18.

The equal-pressure relief valve 18 includes a pressure valve body 22 in a valve housing 19, which upon the opening stroke in the direction of fuel supply lifts up from a valve seat 21 counter to the force of a pressure valve spring 20. The valve housing 19 is held firmly against the cylinder sleeve 12 with a lower flange 23 by a connector fitting 25 which is threaded into the pump housing 11 and retains the cylinder sleeve 12 firmly in the pump housing 11. The valve housing 19 and the pump cylinder 12 are metallically sealed off at their ends in contact with one another.

A relief valve 26 is mounted on the pressure valve body 22 and forms a structural unit with the pressure valve body 22. A beaker-shaped filler piece 31 acts as a housing for the relief valve 26 and includes a valve seat 27, a movable valve element 28 embodied by a ball, a valve spring 29 and a spring plate 30 (see FIG. 1A as well). The area indicated in FIG. 1 which is circled in dot-dash lines is shown on an enlarged scale in FIG. 1A.

The filler piece 31 protrudes with a sheath-like section 31*a* into a chamber 32 which contains the pressure valve spring 20. As shown, the pressure spring encompasses the fiber piece 31*a* and thus reduces the clearance volume between the pressure valve 18 and the injection nozzle. Adjoining the sheath-like section 13*a* toward the pressure valve body 22 is an enlarged shoulder 31*b* and into which a cylindrical recess 31*c* which is widened in conical fashion has been cut at the end. A cylindrical protrusion 22*b*, extending from an offset end face 22*a* of the pressure valve body 22 and having the same diameter as this face 22*a*, protrudes into the cylindrical recess 31*c*. The filler piece 31 is thus mounted on the offset end face 22*a* on the pressure offset end face 22*a* on the pressure valve body 22 which otherwise acts as a support for the pressure valve spring 20, and the pressure valve body 22 and the filler piece 31 are held together in the illustrated status, ready for installation, by a fastener means 45. This fastener means 45 has a crimped ring 46 acting as a fastener ring, which with a first rim 46*a* crimped double at least in some segments engages an annular groove 48 on the pressure valve body 22 and with a second continuous rim 46*b* encompasses the shoulder 31*b* of the filler piece 31. This second continuous rim 46*b* is firmly clamped between the pressure valve spring 20 and a step 33 formed at the transition between the shoulder 31*b* and the sheath-like section 31*a* of the filler piece 31 and acts in turn as a support for the pressure valve spring 20.

Figure 1A:
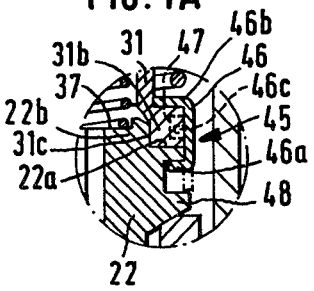
FIG. 1A is a detail A in cross-section of FIG. 1, on an enlarged scale, showing the area of the fastener element.

One variant realization of the crimped ring 46 is indicated in FIG. 1A by broken lines; with a second crimped ring 46*c*, again crimped double at least in segments, it engages an annular groove 47 cut into the shoulder 31*b* of the filler piece 31. If, the first rim 46*a* of the crimped ring 46 or in the alternative variant realization the second rim 46*c* as well is or are crimped or bent double only at some locations, then the associated annular grooves 48 and 47 likewise need not be embodied as continuous; instead, they can also be replaced by corresponding milled recesses in the circumference of the associated parts, should this be more favorable insofar as cost is concerned.

The contact faces existing between the filler piece 31 and the pressure valve body 22, such as the end face 22*a*, are machined as sealing faces, in order to prevent, or at least reduce to a harmless extent, a bypassing of the relief valve 26. The required sealing force is exerted solely by the pressure valve spring 20, so that under all operating conditions the crimped ring 46 is not required to assume or absorb any axial forces.

The valve seat 27 of the relief valve 26, embodied as a ball valve, is cut into an inner bottom face of a bottom 36 of the filler piece 31 remote from the pressure valve body 22, the bottom 36 being provided with a relief bore 35.

The pressure valve body 22 is provided in the area of its cylindrical protrusion 22*b* and a sealing cone 22*c* with a central return-flow bore 38, which depending on the embodiment of the pressure valve body 22 is capable of passing through the pressure valve body in its longitudinal axis (see FIG. 2, for example) or, as shown, discharges into a transverse bore 39 below the sealing cone 22*c* which cooperates with the valve seat 21. By means of this return flow bore 38 with the associated transverse bore 39, the fuel controlled by the relief valve 26 and flowing back to the pump work chamber 16 through the interior of the filler piece 31 is capable of bypassing the valve seat 21 when this valve seat is closed. In order to damp the equal-pressure relief and to prevent uncontrolled oscillations of the relief valve 26, at least one of the bores 35, 38, 39 which during relief experience a flow of fuel is embodied as a throttle bore; this is, preferably the relief bore 35. The return-flow bore 38 or the transverse bore 39 which follows this relief bore 35 during the equal-pressure relief may likewise be embodied as a throttle bore. The two throttle bores must then be adapted to one another such that disadvantageous oscillations of the valve element 28 are avoided and thus an equal-pressure relief which is appropriately adapted by means of the initial stress of the valve spring 29 takes place. The damped relief of the fuel volume located between the pressure valve 18 and the injection nozzle also effects such a severe reduction in the pressure waves occurring in the pressure line 42 which leads to the injection nozzle that the feared after-injections at the injection nozzle do not occur.

Figure 2:
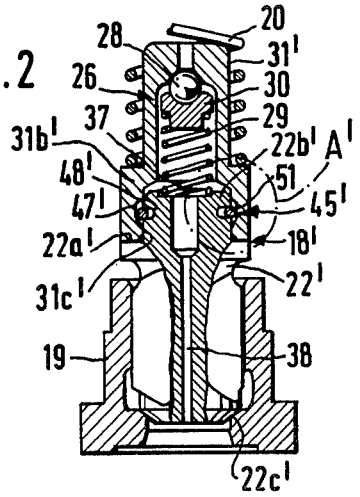
FIG. 2 shows in cross-section the second exemplary embodiment having an equal-pressure relief valve structured differently from that of the embodiment shown in FIG. 1.

The equal-pressure relief valve 18' shown in FIG. 2, which comprises the second preferred exemplary embodiment, in contrast to the equal-pressure relief valve 18 shown in FIG. 1, is provided with a sealing cone 22*c'* toward the bottom on the pressure valve body 22' and in the area of a shoulder 31*b'* of a filler piece 31' has a fastener means 45'. The fastener means 45' comprises a snap connection which permits a slight axial displacement of the filler piece 31' relative to the pressure valve body 22'. When the valve 18' is being disassembled and the pressure valve spring 20 has been removed, this fastener means 45' prevents the valve spring 29 of the relief valve 26 from forcing apart the unit comprising the filler piece 31' and the pressure valve body 22', so that the relatively small parts 28, 29, 30 of the relief valve 26 will not be lost and possibly fall into the pump work chamber 16.

Figure 2A:
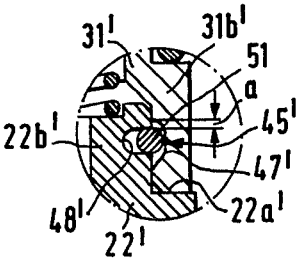
FIG. 2A is a detail A′ is cross-section of FIG. 2, on an enlarged scale, showing the area of the transport fastener.

The fastener means 45' is shown more clearly in the detail A' of FIG. 2, which is illustrated on an enlarged scale in FIG. 2A. It is substantially embodied by a snap ring 51 which functions as a fastener ring. Accordingly, this ring is arranged so that half its wire cross section engages each of the annular grooves 47' and 48' cut into walls oriented toward one another of the filler piece 31' and that of the valve body 22'. The first annular groove 47' is cut into the cylindrical recess 31*c'* of the filler piece 31', and the other annular groove 48' is cut into the cylindrical protrusion 22*b'* on the pressure valve body 22'. The annular groove 48' in the cylindrical protrusion 22*b'* is as wide as the wire diameter of the snap ringe 51, thus guiding the latter in the axial direction, but it is cut so deeply into the section 22*b'* that when the filler piece 31' is being assembled this annular groove 48' is capable of receiving the entire inwardly compressed snap ring 51. The annular groove 47', in accordance with the invention, is embodied as wider than the diameter of the snap ring 51 and has an amount of play "a" relative to the annular groove 47', in the supply direction for instance, so that no axial strain whatever can be transmitted to the snap ring 51 during normal operation of the valve. A conical side wall of the annular groove 47', inclined toward the offset end face 22a' by a small acute angle and not shown in further detail, makes it possible to pull off the filler piece 31', in order to be able to exchange or readjust the component parts of the relief valve 26 as needed.

Figure 3:
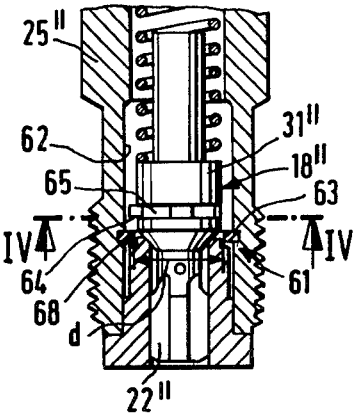
FIG. 3 shows a fragmentary cross-sectional view of the third exemplary embodiment.
Figure 4:
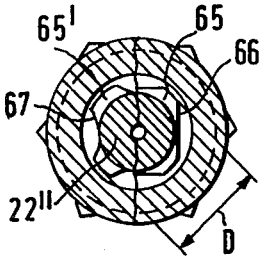
FIG. 4 is a cross section taken along the line IV—IV of FIG. 3.

The third exemplary embodiment shown in FIGS. 3 and 4 differs from those described above solely in the deviant embodiment of the transit fastener, here indicated by reference numeral 61. The fastener ring of the fastener means 61 comprises an outer snap ring 63 set into the wall of a recess 62 in the pipe connector fitting 25" encompassing the equal-pressure relief valve 18". The inside diameter d of the ring 63 is smaller than the outer diameter D (see FIG. 4 as well) of an annular shoulder 65 defined by a step 64 on the pressure valve body 22". This shoulder 65 is disposed behind the snap ring 63 in the supply direction, and the step 64 is disposed at both a radial and an axial distance from the snap ring 63. The annular shoulder 65 is provided on its circumference with flattened areas 66 or recesses 67. In order to illustrate these two possible variant embodiments, the sectional illustration of FIG. 4 is divided by the vertical center axis, and in the right-hand half of the figure the shoulder 65 is shown with the flattened areas 66, while the left-hand half of the figure shows the shoulder, here identified as 65', with the recesses 67. The outer snap ring 63 is held in its installed position, assuring the radial and axial spacing referred to above, by an annular groove 68 cut into the wall of the connector fitting 25".

Figure 5:
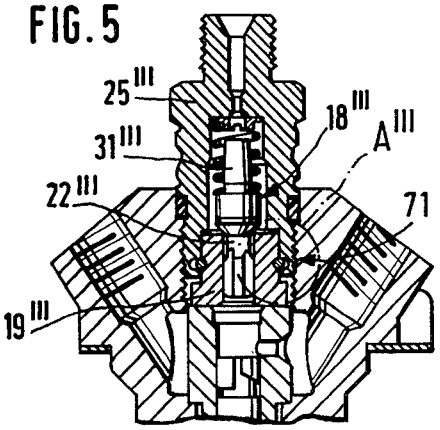
FIG. 5 shows a fragmentary cross-sectional view of a fourth exemplary embodiment.
Figure 5A:
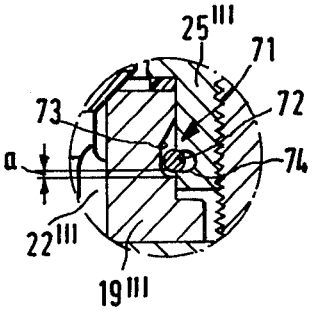
FIG. 5A is a detail A‴ of FIG. 5, seen on an enlarged scale.

In the fourth exemplary embodiment shown in FIGS. 5 and 5A, the fastener means is indicated by reference numeral 71. As in the second exemplary embodiment, it has a fastener ring embodied by a snap ring 72. The snap ring 72 engages both an annular groove 73 on the valve housing 19''' and an annular groove 74 in the connector fitting 25'''. Thus, this fastener means 71, like that of the second exemplary embodiment, is embodied as a snap connection. However, this transit fastener 71 holds the entire equal-pressure relief valve 18''', including the valve housing 19''', firmly together when the pipe connector fitting 25''' is in the disassembled state, so that the components of the relief valve (see 26 in FIG. 1) contained in the filler piece 31''' cannot be lost during removal, yet access to them is possible. The snap ring 72, in the installed state of the valve 18''', has an axial play "a" relative to one of the annular grooves; in the illustrated example, this is the annular groove 73 in the valve housing 19'''.

In contrast to a normal check valve, the pressure valve bodies 22, 22', 22", 22''' of all the exemplary embodiments, shown without a return-feed shoulder which enables an equal-space relief, have in addition to the return-flow bore 38 (see FIGS. 1 and 2) and the transverse bore 39 described above a further cylindrical depression 37, which acts as a support for the valve spring 29. Should the valve 18, 18', 18", 18''' be intended to control not only the required equal-pressure relief but also an equal-space relief as well, then naturally it is also possible for the pressure valve body 22, 22', 22", 22''' to be equipped with a known return-feed shoulder (disposed, for instance, below the sealing cone 22c of FIG. 1). This alternative application is known from Swiss Pat. No. 394,710, for instance. However, the exemplary embodiments not equipped with the return-feed shoulder have the advantage, because of the resultant short valve stroke, that the mass of the relief valve 26 which must be added to the mass of the pressure valve body 22, 22', 22", 22''' does not have a disadvantageous effect.

If an existing fuel injection pump is retrofitted with the equal-pressure relief valves according to the invention, then in an embodiment as shown in FIGS. 1 and 2 the pressure valve body 22, 22' can be reworked as needed, while the valve housing 19, the pressure valve spring 20 and the pipe connector fitting 25 can continue to be used, unaltered. In the exemplary embodiments of FIGS. 3 and 5, less reworking of the pressure valve body 22", 22''' is required, and the pipe connector fitting 25" or the valve housing 19''' and the pipe connector fitting ''' need merely be provided with annular grooves.

The mode of operation of the equal-pressure relief valves 18, 18', 18" and 18''' differs only imperceptibly from that of known equal-pressure relief valves and will accordingly be described only briefly below in terms of the exemplary embodiment shown in FIG. 1:

During a supply stroke of the injection pump described in connection with FIG. 1, the fuel to be injected is fed by the pump piston 15 from the pump work chamber 16 via the valve seat 21, which has been opened by the pressure valve body 22, the chamber 32 and the pressure line 42 to the injection nozzle. At the end of injection, when the oblique control edge 14 on the pump piston 15 opens a control bore 43 in the wall of the pump cylinder 12, the pressure in the pump work chamber 16 drops abruptly, the pressure valve body 22 of the valve 18 closes the valve seat 21, and the remnant pressure remaining in the pressure line 42 and in the chamber 32 as well acts upon the valve element 28 of the relief valve 26 via the relief bore 35 connecting the chamber 32 with the pump work chamber 16. This valve 26 is forced open and connects the chamber 32 with the pressure-relieved pump work chamber 16 via the return-flow bore 38 and transverse bore 39. The initial stress of the valve spring 29 of the relief valve 26 and also, if necessary, the relief bore 35 and/or the transverse bore 39 embodied as a throttle bore determine the pressure level to which relief is effected and the speed with which relief is effected. The fastener means 45 neither affects nor restricts the functioning of the valve 18. The fastener means is effective only when the valve 18 is disassembled, and it prevents the pressure valve body 22 and the filler piece 31 from coming apart, thus preventing the parts 28, 29, 30 of the relief valve 26 contained in the filler piece 31 from falling out.

The mode of operation of the equal-pressure relief valves 18', 18", 18''' described in the other figures of the drawing is the same as that of the first exemplary embodiment shown in FIG. 1, except for the different embodiment of the fasteners means 45', 61, 71.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a pump housing and a reciprocating pump piston means defining a pump work chamber as well as an equal-pressure relief valve means inserted into the pressure line leading to an injection valve each said means secured in said pump housing by means of a connector fitting, wherein said equal-pressure relief valve comprises an assembly including a valve housing, a housed pressure valve body opening in the supply direction of the fuel counter to the force of a pressure valve spring and a relief valve opening counter to the supply direction of the fuel, said relief valve further including a valve spring supported on said pressure valve body and said housing therefor being embodied as a beaker-shaped filler piece disposed inside said pressure valve spring, said filler piece being mounted on a cylindrical protrusion of said pressure valve body and adapted to contain said relief valve, characterized in that said equal-pressure relief valve is provided with a fastener means for securing at least a portion of said assembly comprising said pressure valve body said filler piece and said relief valve as a unit when said connector fitting is removed.

2. A fuel injection pump as defined by claim 1, characterized in that said pressure valve body and said filler piece are held together by means of said fastener means even when said pressure valve spring is removed.

3. A fuel injection pump as defined by claim 2, characterized in that said fastener means is embodied as a snap connection which provides for a slight axial displacement of said the filler piece relative to said pressure valve body.

4. A fuel injection pump as defined by claim 3, wherein said filler piece comprises a sheath-like section of smaller diameter and a wider shoulder, characterized in that said shoulder terminates in a perimetral area which surrounds a recess, said pressure valve body further provided with a protrusion which is received in said recess of said perimetral area beneath said shoulder, each said interfitting elements provided with confronting wall areas having annular grooves and a snap ring disposed in said grooves to retain said elements in assembled relation.

5. A fuel injection pump as defined by claim 4, characterized in that at least one of said annular grooves is provided with has a play (a) relative to said snap ring in the direction of the longitudinal axis of said pressure valve body which permits an axial displacement of said filler piece.

6. A fuel injection pump as defined by claim 2, wherein the filler piece comprises a sheath-like section of smaller diameter and a wider shoulder, characterized in that said fastener means is formed by a crimped ring which holds said pressure valve body and said filler piece together said pressure valve body further having an annular groove and said filler piece provided with a shoulder into each of which portions of said fastener are crimped, whereby a unitary assembly is attained.

7. A fuel injection pump as defined by claim 2, wherein said filler piece comprises a sheath-like section of smaller diameter and a wider shoulder, characterized in that said fastener means comprises a crimped ring which retains said pressure valve body and said filler piece together, said crimped ring further including a first means a first rim adapted to engage an annular groove on said pressure valve body and a second means adapted to engage an annular groove provided in said shoulder of said filler piece.

8. A fuel injection pump as defined by claim 1, characterized in that said connector fitting has an inner wall provided with a recess, an outer snap ring inserted into said recess and arranged to encompass said equal-pressure relief valve, said snap ring further having an inside diameter (d) which is smaller than the outer diameter (D) of an annular shoulder defined by a step on said pressure valve body, and further that this shoulder is disposed behind said snap ring and said step is spaced apart both radially and axially from said snap ring at all times.

9. A fuel injection pump as defined by claim 8, characterized in that said annular shoulder has a circumference which is provided with flattened areas and recesses.

10. A fuel injection pump as defined by claim 1, characterized in that said fastener means for said equal-pressure relief valve comprises a snap connection adapted to hold said equal-pressure relief valve and said valve housing inside said pipe connector fitting even in the disassembled state.

11. A fuel injection pump as defined by claim 10, characterized in that said fastener ring of said fastener means comprises a snap ring arranged to engage both an annular groove on said valve housing and an annular groove in said connector fitting, said snap ring having an axial play (a) relative to one of said annular grooves in the installed state of the valve.

* * * * *